US011024978B2

(12) United States Patent
Liu et al.

(10) Patent No.: US 11,024,978 B2
(45) Date of Patent: Jun. 1, 2021

(54) ANTENNA

(71) Applicant: AAC Technologies Pte. Ltd., Singapore (SG)

(72) Inventors: Jianchuan Liu, Shenzhen (CN); Yuehua Yue, Shenzhen (CN); Qingchen Chu, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/996,947

(22) Filed: Aug. 19, 2020

(65) Prior Publication Data

US 2020/0412013 A1 Dec. 31, 2020

Related U.S. Application Data

(63) Continuation of application No. PCT/CN2019/094037, filed on Jun. 30, 2019.

(51) Int. Cl.
*H01Q 1/36* (2006.01)
*H01Q 21/00* (2006.01)
*H01Q 1/24* (2006.01)

(52) U.S. Cl.
CPC ..... *H01Q 21/0006* (2013.01); *H01Q 1/241* (2013.01); *H01Q 1/36* (2013.01)

(58) Field of Classification Search
CPC ..... H01Q 21/00; H01Q 21/0006; H01Q 21/0087; H01Q 1/241; H01Q 1/246; H01Q 1/36
See application file for complete search history.

(56) References Cited

U.S. PATENT DOCUMENTS 8,957,824 B2 * 2/2015 Choi ..... H01Q 21/26 343/795
2002/0163477 A1 * 11/2002 Eriksson ..... H01Q 1/246 343/815
2005/0253769 A1 * 11/2005 Timofeev ..... H01Q 21/26 343/797
2007/0241983 A1 * 10/2007 Cao ..... H01Q 21/26 343/797
2010/0007571 A1 * 1/2010 Riedel ..... H01Q 21/26 343/797
2012/0280882 A1 * 11/2012 Zimmerman ..... H01Q 15/141 343/836
2014/0125539 A1 * 5/2014 Katipally ..... H01Q 21/062 343/794

* cited by examiner

*Primary Examiner* — Thai Pham
(74) *Attorney, Agent, or Firm* — W&G Law Group LLP

(57) ABSTRACT

An antenna includes an antenna body, a feeding network board screw-connected to the antenna body, and a feeding spring pin connecting the coupling feeding branch with a feeding network of the feeding network board. The antenna body includes a plastic bracket, an antenna radiating sheet provided on a top of the plastic bracket, and a coupling feeding branch provided on a side portion of the plastic bracket. The plastic bracket is formed into one piece, the antenna radiating sheet and the coupling feeding branch are spaced apart from and coupled with each other. The antenna of the present invention has good consistency, high reliability, is easy to assemble without welding, and has a simple overall structure, low cost and small size, and can be used for 5G large-scale antenna array deployment.

9 Claims, 4 Drawing Sheets

ANTENNA

TECHNICAL FIELD

The present invention relates to the field of antennas and, in particular, to an antenna.

BACKGROUND

An antenna includes an antenna radiating sheet, a coupling feeding branch coupled with the antenna radiating sheet, a feeding network board connected to the coupling feeding branch, and a plastic bracket installed on a side surface of the feeding network board and used for mounting the antenna radiating sheet and the coupling feeding branch. The antenna in the related art has a complicated structure, is difficult to assemble, and has a high cost.

Therefore, it is necessary to provide an antenna that has a simple structure, low cost, and high reliability and is easily assembled.

SUMMARY

The present invention provides an antenna having a simple structure, low cost, and high reliability and is easily assembled.

An antenna is provided. The antenna includes an antenna body including a plastic bracket, an antenna radiating sheet provided on a top of the plastic bracket, and a coupling feeding branch provided at a side portion of the plastic bracket; a feeding network board screw-connected to the antenna body and provided with a feeding network; and a feeding network board screw-connected to the antenna body and provided with a feeding network. The plastic bracket is formed into one piece, and the antenna radiating sheet and the coupling feeding branch are spaced apart from and coupled with each other.

As an improvement, the plastic bracket comprises a first plate body and a supporting frame connected to a bottom of the first plate body. The supporting frame includes a connecting post having one end connected to the bottom of the first plate body and another end connected to the feeding network board, and a plurality of connecting plates. Each of the plurality of connecting plates has one side connected to the bottom of the first plate body and another side adjacent to the one side connected to a peripheral surface of the connecting post, and the first plate body, the connecting post and the plurality of connecting plates are formed into one piece. The antenna radiating sheet is provided on a top surface of the first plate body, the coupling feeding branch is provided on a side surface of one of the plurality of connecting plates, and the connecting post and the feeding network board are connected by a screw.

As an improvement, the connecting post is in contact with the feeding network board, an end surface of the connecting post facing away from the first plate body is recessed towards the first plate body to form a first connecting hole, the feeding network board is provided with a second connecting hole, and the screw is inserted into the second connecting hole and the first connecting hole sequentially to hook the feeding network board and the connecting post.

As an improvement, the first connecting hole is a threaded hole.

As an embodiment, the plurality of the connecting plates is equally distributed along a circumferential direction of the connecting post.

As an improvement, the antenna radiating sheet is formed on the first plate body by laser direct structuring, and the coupling feeding branch is formed on the one of the plurality of connecting plates by the laser direct structuring.

As an improvement, each of the plurality of connecting plates is spaced apart from the feeding network, the feeding spring pin comprises a connecting tab and two clamping tabs respectively extending in a same direction from two side portions of the connecting tab, the connecting tab is in contact with the feeding network, and the two clamping tabs clamp the connecting plate and the coupling feeding branch therebetween.

As an improvement, the connecting tab and the feeding network are welded to each other.

As an improvement, the clamping tab comprises a first tab body, a second tab body connected to an end of the first tab body, and a curved tab body connecting another end of the first tab body with an end of the connecting tab, the first tab body extends obliquely from the curved tab body towards the clamping tab located at an opposite side, and the second tab body extends obliquely from the first tab body along a direction facing away from the clamping tab located at the opposite side.

As an improvement, the feeding network is a differential feeding network.

The plastic bracket is formed into one piece to realize a good consistency, the plastic bracket and the feeding network board are screw-connected to each other to realize a high reliability, and the coupling feeding branch is connected to the feeding network by the feeding spring pin, making it easy to assemble without welding. The antenna has a simple overall structure, low cost, small size, and can be used for 5G large-scale antenna array deployment.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present invention. Moreover, in the drawings, like reference numerals designate corresponding parts throughout the several views.

In the drawing.

100, antenna; 1, plastic bracket; 21, feeding network board; 22, feeding network; 3, screw 4, antenna radiating sheet; 5, coupling feeding branch; 6, feeding spring pin; 11, first plate body; 12, supporting frame; 121, connecting post; 122, connecting plate; 101, first connecting hole; 61, connecting tab; 62, clamping tab; 621, first tab body; 622, second tab body; 623, curved tab body.

DESCRIPTION OF EMBODIMENTS

The present invention will be further described below with reference to the accompany drawings and embodiments.

Figure 1:
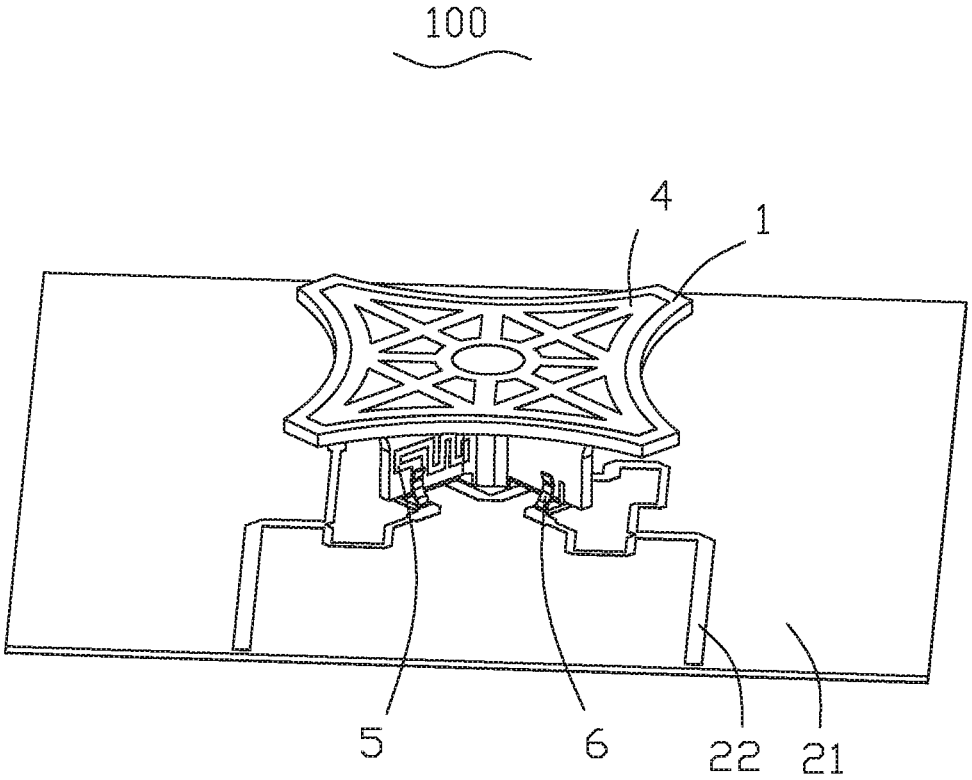
FIG. 1 is a schematic diagram of an antenna.
Figure 2:
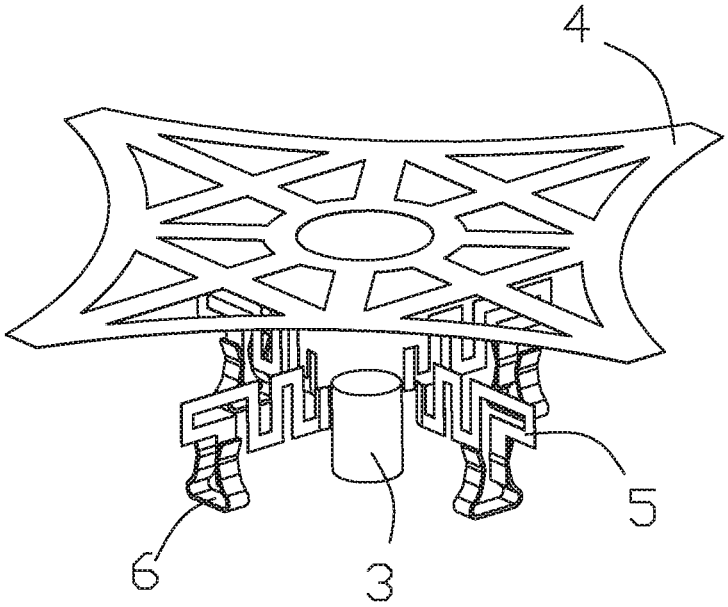
FIG. 2 is a schematic diagram of an antenna radiating sheet, a coupling feeding branch, a feeding spring pin, and a screw of an antenna.
Figure 3:
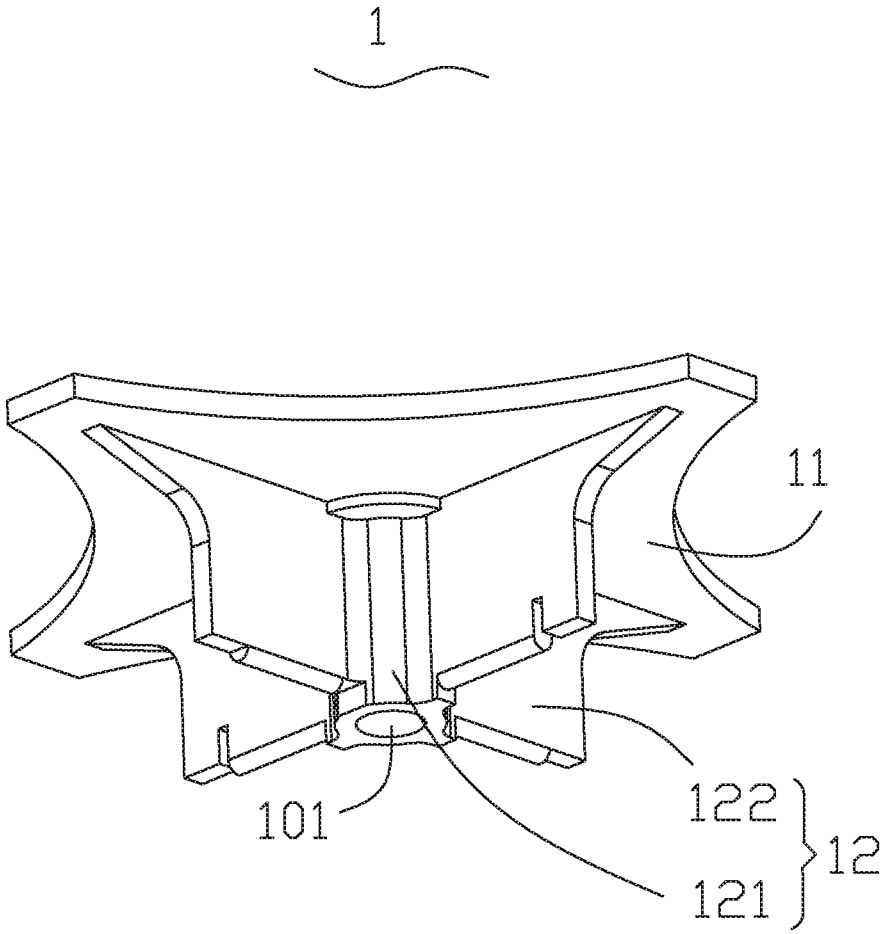
FIG. 3 is a schematic diagram of a plastic bracket of an antenna.

An antenna 100 is provided. Referring to FIG. 1 to FIG. 3, the antenna 100 includes an antenna body (not marked in the drawing) and a feeding network board 21 screw-connected to the antenna body, and the feeding network board 21 is provided with a feeding network 22. The antenna body includes a plastic bracket 1, an antenna radiating sheet 4 provided on a top of the plastic bracket 1, and a coupling feeding branch 5 provided on a side portion of the plastic bracket 1. The plastic bracket 1 is formed into one piece. The antenna radiating sheet 4 and the coupling feeding branch 5 are coupled with each other. The antenna 100 further includes a feeding spring pin connecting the coupling feeding branch 5 with the feeding network 22.

The plastic bracket 1 is formed into one piece to achieve a good consistency, the plastic bracket 1 and the feeding network board 21 are hooked by a screw 3 to achieve a high reliability, and the coupling feeding branch 5 is connected to the feeding network board 21 by a feeding spring pin 6, which is easy to assemble without welding. Thus, the antenna 100 has a simple overall structure, low cost, and a small size, and can be used for 5G large-scale antenna array deployment.

In an embodiment, the plastic bracket 1 includes a first plate body 11 and a supporting frame 12 connected to a bottom of the first plate body 11, the supporting frame 12 includes a connecting post 121 having one end connected to the bottom of the first plate body 11 and another end connected to the feeding network board 21, and a plurality of connecting plates 122. Each connecting plate 122 has one side connected to the bottom of the first plate body 11 and another side adjacent to the one side and connected to a peripheral surface of the connecting post 121. The first plate body 11, the connecting post 121 and the connecting plate 122 are formed into one piece.

The antenna radiating sheet 4 is provided on a top surface of the first plate body 11, and the coupling feeding branch 5 is provided on a side surface of the connecting plate 122.

The connecting post 121 and the feeding network board 21 are connected by the screw 3.

The connecting post 121 and the plurality of the connecting plates 122 support the first plate body 11 together, and the overall structure is stable. Connection between the antenna radiating sheet 4, the coupling feeding branch 5 and the plastic bracket 1 facilitates the coupling between the antenna radiating sheet 4 and the coupling feeding branch 5.

In an embodiment, the connecting post 121 is in contact with the feeding network board 21, an end surface of the connecting post 121 facing away from the first plate body 11 is recessed towards the first plate body 11 to form a first connecting hole 101, the feeding network board 21 is provided with a second connecting hole (not marked in the drawing), and the screw 3 sequentially passes through the second connecting hole and the first connecting hole 101 to hook the feeding network board 21 and the connecting post 121.

The screw 3 passes through the feeding network board 21 from a bottom of the feeding network board 21 and is connected to the connecting post 121, such that the screw 3 has good concealment, occupies less space, and has high connection strength. In an embodiment, the first connecting hole 101 is a threaded hole.

In an embodiment, the plurality of the connecting plates 122 are equally distributed along a circumference of the connecting post 121, to improve overall stability of the plastic bracket 1.

In an embodiment, the antenna radiating sheet 4 is formed on the first plate body 11 by laser direct structuring (LDS), and the coupling feeding branch 5 is formed on the connecting plate 122 by laser direct structuring (LDS). In this way, the antenna radiating sheet 4 can be more stably mounted on the first plate body 11, and the coupling feeding branch 5 can be more stably mounted on the connecting plate 122.

In an embodiment, the connecting plate 122 is spaced apart from the feeding network 22, the feeding spring pin 6 includes a connecting tab 61 and two clamping tabs 62. Two clamping tabs 62 respectively extend in a same direction from two side portions of the connecting tab 61, the connecting tab 61 is in contact with the feeding network 22, and the two clamping tabs 62 clamp the connecting plate 122 and the coupling feeding branch 5 therebetween.

The feeding spring pin 6 serves to electrically connect the coupling feeding branch 5 with the feeding network 22, also plays a certain role in supporting the connecting plate 122 and facilitates an overall structure design of the coupling feeding branch 5.

In an embodiment, the connecting tab 61 is welded to the feeding network 22. In this way, the feeding spring pin 6 and the feeding network 22 is in contact with each other stably, such that the connection between the coupling feeding branch 5 and the feeding network 22 is stable.

Figure 4:
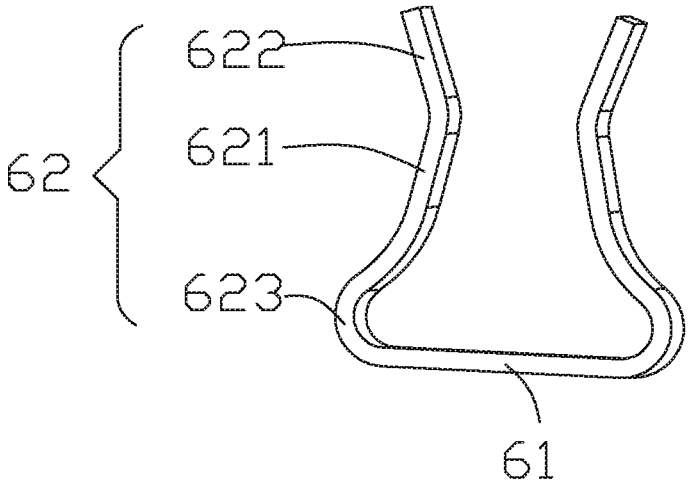
FIG. 4 is a schematic diagram of a feeding spring pin of an antenna.

In an embodiment, referring to FIG. 4, the clamping tab 62 includes a first tab body 621, a second tab body 622 connected to an end of the first tab body 621, and a curved tab body 623 connecting another end of the first tab body 621 with an end of the connecting tab 61, the first tab body 621 extends obliquely from the curved tab body 623 towards the clamping tab 62 located at an opposite side, and the second tab body 622 extends obliquely from the first tab body 621 along a direction facing away from the clamping tab 62 located at the opposite side.

The first tab bodies 621 at two opposite sides gradually approach, to improve a clamping effect of the two clamping tabs 62, and the two second tab bodies 622 are gradually away from each other, to facilitate the feeding spring pin 6 being clamped outside the connecting plate 122 and the coupling feeding branch 5.

In an embodiment, the feeding network 22 is a differential feeding network.

The antenna 100 provided by the present invention, the plastic bracket 1 is formed into one piece to achieve a good consistency, the plastic bracket 1 and the feeding network board 21 are fixed to each other by the screw 3 to achieve a high reliability, and the coupling feeding branch 5 is connected to the feeding network 22 by the feeding spring pin 6, making it easy to assemble without welding, so the overall structure is simple, the cost is low, the size is small, and it can be used for 5G large-scale antenna array deployment.

It should be noted that, the above are merely embodiments of the present invention, those skilled in the art can make improvements without departing from the inventive concept of the present invention, however, these improvements shall belong to the protection scope of the present invention.

What is claimed is:

1. An antenna, comprising:

an antenna body comprising a plastic bracket, an antenna radiating sheet provided on a top of the plastic bracket, and a coupling feeding branch provided at a side portion of the plastic bracket, wherein the plastic bracket is formed into one piece, and the antenna radiating sheet and the coupling feeding branch are spaced apart from and coupled with each other;

a feeding network board screw-connected to the antenna body and provided with a feeding network; and a feeding spring pin connecting the coupling feeding branch with the feeding network;

wherein the plastic bracket comprises a first plate body and a supporting frame connected to a bottom of the first plate body, wherein the supporting frame comprises:

a connecting post having one end connected to the bottom of the first plate body and another end connected to the feeding network board, and a plurality of connecting plates, wherein each of the plurality of connecting plates has one side connected to the bottom of the first plate body and another side adjacent to the one side and connected to a peripheral surface of the connecting post, and the first plate body, the connecting post and the plurality of connecting plates are formed into one piece;

the antenna radiating sheet is provided on a top surface of the first plate body, the coupling feeding branch is provided on a side surface of one of the plurality of connecting plates, and the connecting post and the feeding network board are connected by a screw.

2. The antenna as described in claim 1, wherein the connecting post is in contact with the feeding network board, an end surface of the connecting post facing away from the first plate body is recessed towards the first plate body to form a first connecting hole, the feeding network board is provided with a second connecting hole, and the screw is inserted into the second connecting hole and the first connecting hole sequentially to lock the feeding network board and the connecting post.

3. The antenna as described in claim 2, wherein the first connecting hole is a threaded hole.

4. The antenna as described in claim 1, wherein the plurality of the connecting plates is equally distributed along a circumferential direction of the connecting post.

5. The antenna as described in claim 1, wherein the antenna radiating sheet is formed on the first plate body by laser direct structuring, and the coupling feeding branch is formed on the one of the plurality of connecting plates by the laser direct structuring.

6. The antenna as described in claim 1, wherein, each of the plurality of connecting plates is spaced apart from the feeding network, the feeding spring pin comprises a connecting tab and two clamping tabs respectively extending in a same direction from two side portions of the connecting tab, the connecting tab is in contact with the feeding network, and the two clamping tabs clamp the connecting plate and the coupling feeding branch therebetween.

7. The antenna as described in claim 6, wherein the connecting tab and the feeding network are welded to each other.

8. The antenna as described in claim 6, wherein, the clamping tab comprises a first tab body, a second tab body connected to an end of the first tab body, and a curved tab body connecting another end of the first tab body with an end of the connecting tab, the first tab body extends obliquely from the curved tab body towards the clamping tab located at an opposite side, and the second tab body extends obliquely from the first tab body along a direction facing away from the clamping tab located at the opposite side.

9. The antenna as described in claim 1, wherein the feeding network is a differential feeding network.

* * * * *